US011459730B1

(12) United States Patent
Henn et al.

(10) Patent No.: US 11,459,730 B1
(45) Date of Patent: Oct. 4, 2022

(54) HYDRAULIC LOAD BRAKE SYSTEM

(71) Applicant: DEERE & COMPANY, Moline, IL (US)

(72) Inventors: Grant R. Henn, Dubuque, IA (US); Benjamin R. Wagner, Dubuque, IA (US); Andrew Humke, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/459,577

(22) Filed: Aug. 27, 2021

(51) Int. Cl.
*E02F 9/22* (2006.01)
*F15B 15/20* (2006.01)

(52) U.S. Cl.
CPC ..... *E02F 9/2228* (2013.01); *E02F 9/2246* (2013.01); *E02F 9/2267* (2013.01); *F15B 15/202* (2013.01)

(58) Field of Classification Search
CPC ..... E02F 9/2267; E02F 9/2228; E02F 9/2075; F15B 15/202; B60W 20/13
See application file for complete search history.

(56) References Cited

U.S. PATENT DOCUMENTS 9,037,356 B2 * 5/2015 Kawasaki ..... E02F 9/2217 701/50
2007/0289298 A1 * 12/2007 Thompson ..... F15B 1/021 60/469
2010/0186404 A1 * 7/2010 Yasufuku ..... B60W 10/30 60/459
2016/0289923 A1 * 10/2016 Ishihara ..... E02F 9/2217

* cited by examiner

*Primary Examiner* — Abiy Teka
(74) *Attorney, Agent, or Firm* — Michael Best & Friedrich LLP

(57) ABSTRACT

A hydraulic system for a work vehicle that has a frame, a ground-engaging implement that moves the frame over a ground surface, and an attachment connected to the frame for movement with respect to the frame. The hydraulic system includes a pump that pumps hydraulic fluid, a first conduit fluidly connecting the pump and the attachment, a reservoir that contains hydraulic fluid, a second conduit fluidly connecting the pump to the reservoir, a fluid resistor fluidly connected with the second conduit, and a valve. The fluid resistor dissipates power from the work vehicle. The valve actuates between a first state in which the valve fluidly connects the pump to the first conduit such that hydraulic fluid is directed to the attachment, and a second state in which the valve fluidly connects the pump to the second conduit such that fluid is directed through the fluid resistor and into the reservoir.

16 Claims, 3 Drawing Sheets

HYDRAULIC LOAD BRAKE SYSTEM

BACKGROUND

The present disclosure relates to a work vehicle, a control system for use in a work vehicle and a hydraulic system for use in a work vehicle.

SUMMARY

In one embodiment, the disclosure provides a work vehicle including a frame, a ground-engaging implement that moves the frame over a ground surface, an attachment connected to the frame for movement with respect to the frame, a controller in electrical communication with the attachment, and a hydraulic system in electrical communication with the controller. The hydraulic system includes a pump that pumps hydraulic fluid, a first conduit that fluidly connects the pump and the attachment, a reservoir that contains hydraulic fluid, a second conduit that fluidly connects the pump to the reservoir, a fluid resistor fluidly connected with the second conduit, the fluid resistor that dissipates power from the work vehicle, and a valve. The valve actuates between a first state in which the valve fluidly connects the pump to the first conduit such that hydraulic fluid is directed to the attachment, and a second state in which the valve fluidly connects the pump to the second conduit such that fluid is directed through the fluid resistor and into the reservoir.

In another embodiment the disclosure provides a control system for a work vehicle that has a frame, a ground-engaging implement that moves the frame over a ground surface, and an attachment connected to the frame for movement with respect to the frame. The control system includes a controller in electrical communication with the attachment, a battery in electrical communication with the controller such that the controller monitors a battery state of charge, a pump that pumps hydraulic fluid in response to a signal from the controller, and a valve in electrical communication with the controller. The valve actuates between a first state in which the valve fluidly connects the pump to the attachment in response to a first signal from the controller, and a second state in which the valve fluidly connects the pump to a fluid resistor in response to a second signal from the controller. The fluid resistor dissipates power from the work vehicle. While the battery state of charge indicates that the battery is able to receive a further charge, the controller sends the first signal to actuate the valve to the first state, and while the battery state of charge indicates that the battery is unable to receive a further charge, the controller sends the second signal to actuate the valve to the second state.

In another embodiment the disclosure provides a hydraulic system for a work vehicle that has a frame, a ground-engaging implement that moves the frame over a ground surface, and an attachment connected to the frame for movement with respect to the frame. The hydraulic system includes a pump that pumps hydraulic fluid, a first conduit fluidly connecting the pump and the attachment, a reservoir that contains hydraulic fluid, a second conduit fluidly connecting the pump to the reservoir, a fluid resistor fluidly connected with the second conduit, and a valve. The fluid resistor dissipates power from the work vehicle. The valve actuates between a first state in which the valve fluidly connects the pump to the first conduit such that hydraulic fluid is directed to the attachment, and a second state in which the valve fluidly connects the pump to the second conduit such that fluid is directed through the fluid resistor and into the reservoir.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
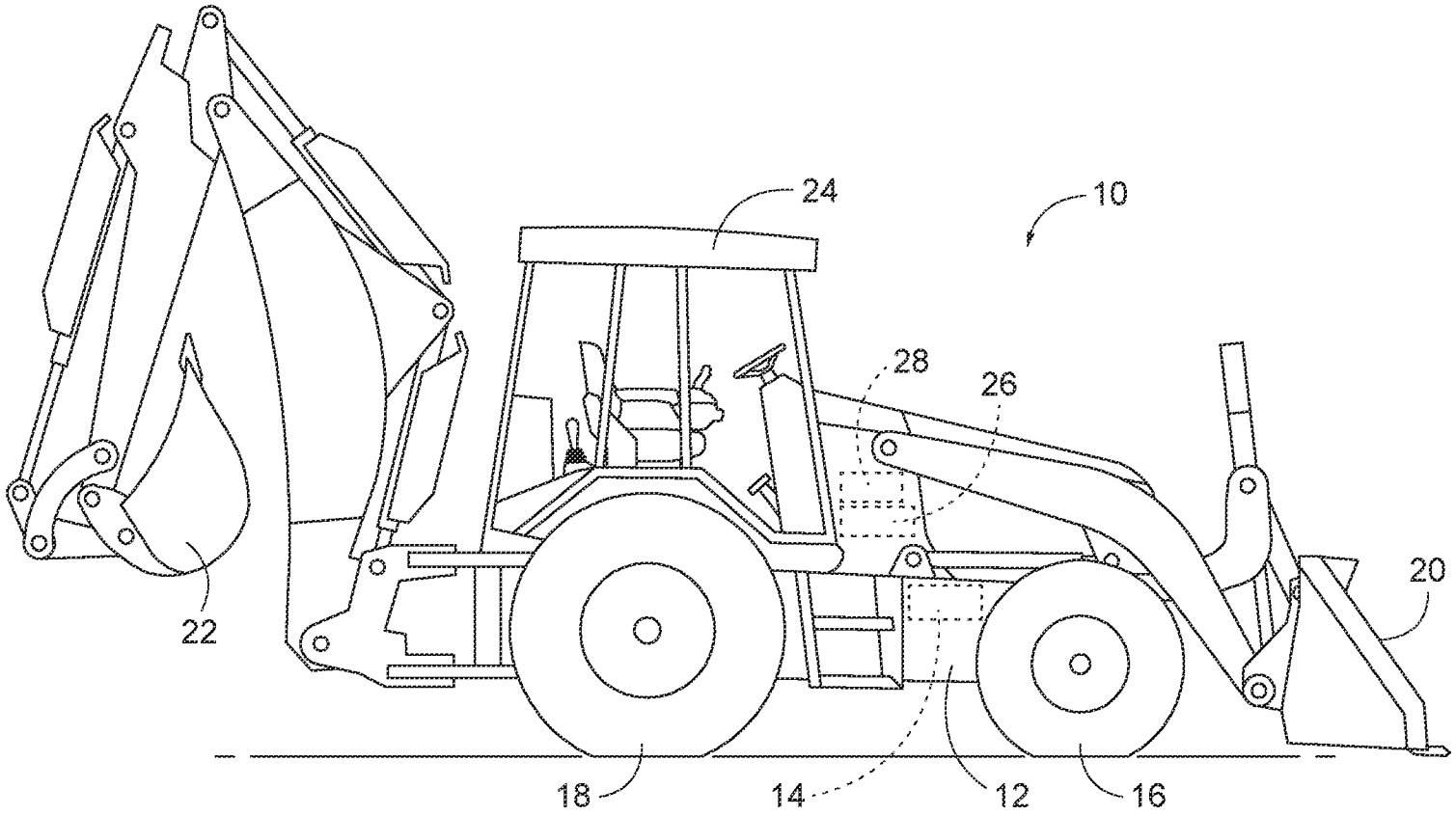
FIG. 1 is a side view of a work vehicle according to some embodiments.

FIG. 1 illustrates a work vehicle 10 that includes a frame 12, a motor 14, front wheels 16, rear wheels 18, a first attachment 20, a second attachment 22, an operator cab 24, a controller 26, and a battery 28. The illustrated work vehicle 10 is a backhoe, however, the disclosure may extend to other work vehicles such as, an excavator, loader, crawler, harvester, skidder, feller buncher, motor grader, or any other work vehicle. As such, while the figures and forthcoming description may relate to a backhoe, it is to be understood that the scope of the present disclosure extends beyond a backhoe and, where applicable, the term "vehicle" or "work vehicle" will be used instead. The term "vehicle" or "work vehicle" is intended to be broader and encompass other vehicles besides a backhoe for purposes of this disclosure.

The motor 14 is coupled to the frame 12 and is configured to rotate the front and rear wheels 16, 18 to move the work vehicle 10 over a ground surface. In other embodiments, different ground-engaging implements, such as treads or tracks can be used in place of the front and rear wheels 16, 18.

The first attachment 20 is coupled to a front portion of the work vehicle 10 and the second attachment 22 is coupled to a rear portion of the work vehicle 10. The first and second attachments 20, 22 are connected to the frame 12 for movement with respect to the frame 12. In some embodiments, other attachments can be utilized in place of the illustrated attachments.

The operator cab 24 includes an operator support and a user interface that is in electrical communication with the controller 26. The controller 26 is in electrical communication with the first attachment 20 and with the second attachment 22. The controller 26 sends signals to the first attachment 20 and the second attachment 22 to cause movement of the respective attachment 20, 22.

Figure 2:
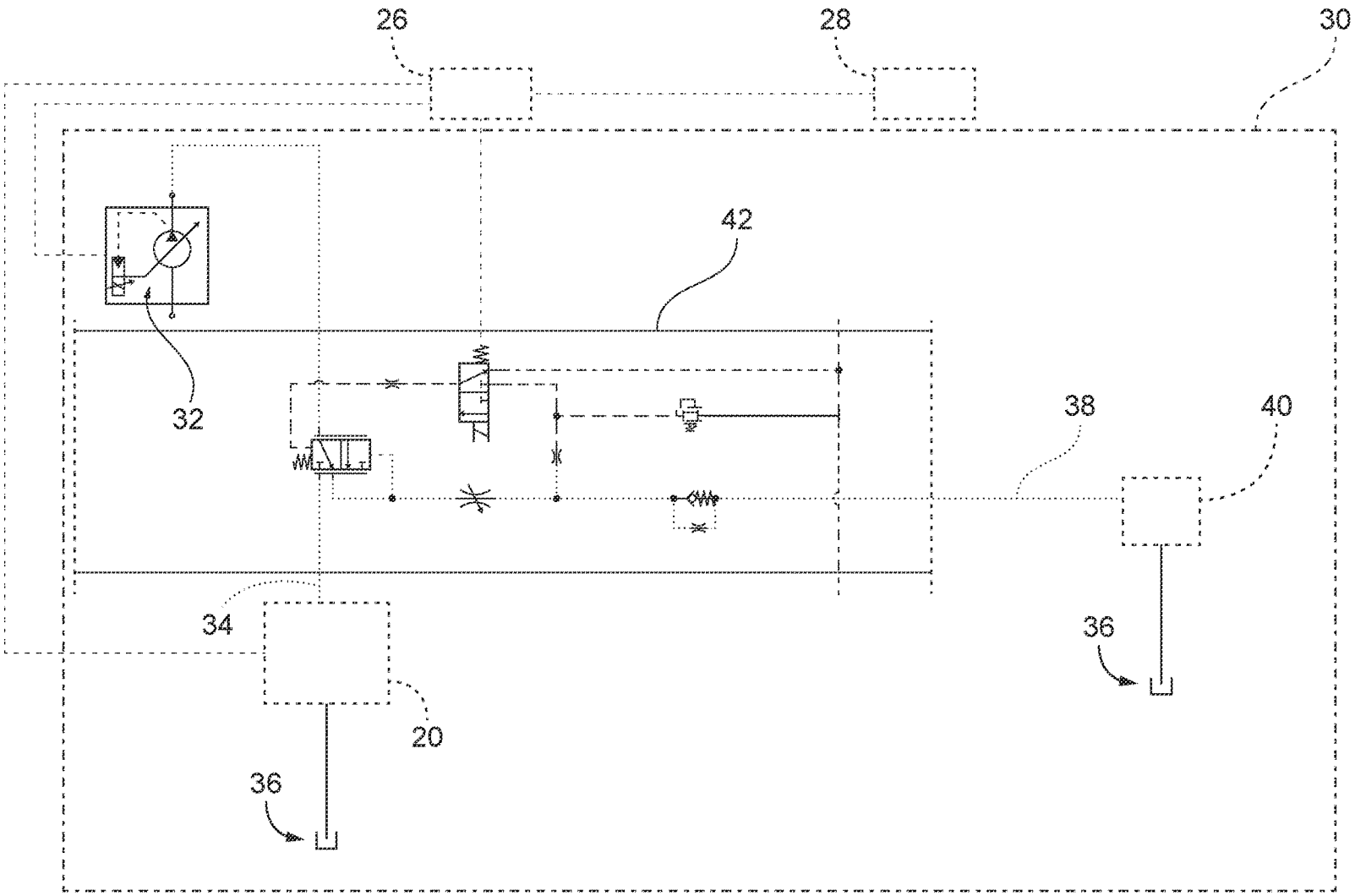
FIG. 2 is a schematic view of a control system of the work vehicle of FIG. 1.

FIG. 2 illustrates a control system that includes the controller 26, the battery 28 and a hydraulic system 30. The controller 26 is in electrical communication with the battery 28 such that the controller 26 monitors a state of charge of the battery 28. The controller 26 is in electrical communication with the hydraulic system 30.

The hydraulic system 30 includes a pump 32, a first conduit 34, a reservoir 36, a second conduit 38, a fluid resistor 40, and a valve 42. The pump 32 pumps hydraulic fluid in response to a signal from the controller 26. While the illustrated pump 32 is a displacement-controlled pump, other suitable pumps could be used in other embodiments.

The first conduit 34 connects the pump 32 and the first attachment 20. The reservoir 36 contains hydraulic fluid and, in the illustrated embodiment, is fluidly connected to the first attachment 20. The second conduit 38 selectively fluidly connects the pump 32 to the reservoir 36.

The fluid resistor 40 is fluidly connected with the second conduit 38 between the valve 42 and the reservoir 36. The fluid resistor 40 dissipates power from the work vehicle 10. In some embodiments, the fluid resistor 40 is a fixed orifice. In other embodiments, the fluid resistor 40 is a needle valve.

The valve 42 is in electrical communication with the controller 26. The valve 42 is actuatable between a first state and a second state in response to one or more signals from the controller 26. In the first state, the valve 42 fluidly connects the pump 32 to the second attachment 22. In the second state, the valve 42 fluidly connects the pump 32 to the fluid resistor 40. In some embodiments, the valve 42 is one of the valves in a valve stack associated with the first attachment 20 of the work vehicle 10. In some embodiments, the valve 42 is one of the valves in a valve stack associated with the second attachment 22 of the work vehicle 10.

The controller 26 monitors a state of charge of the battery 28. While the state of charge of the battery 28 indicates that the battery 28 is not fully charged, and thus capable of receiving a further charge, the controller 26 sends a first signal to actuate the valve 42 to the first state. While the charge status of the battery 28 indicates that the battery 28 is fully charged, and thus unable to receive a further charge, the controller 26 sends a second signal to actuate the valve 42 to the second state. While the chare status of the battery 28 indicates that the battery is too hot or too cold to receive a further charge, the controller 26 sends the second signal to actuate the valve 42 to the second state.

Figure 3:
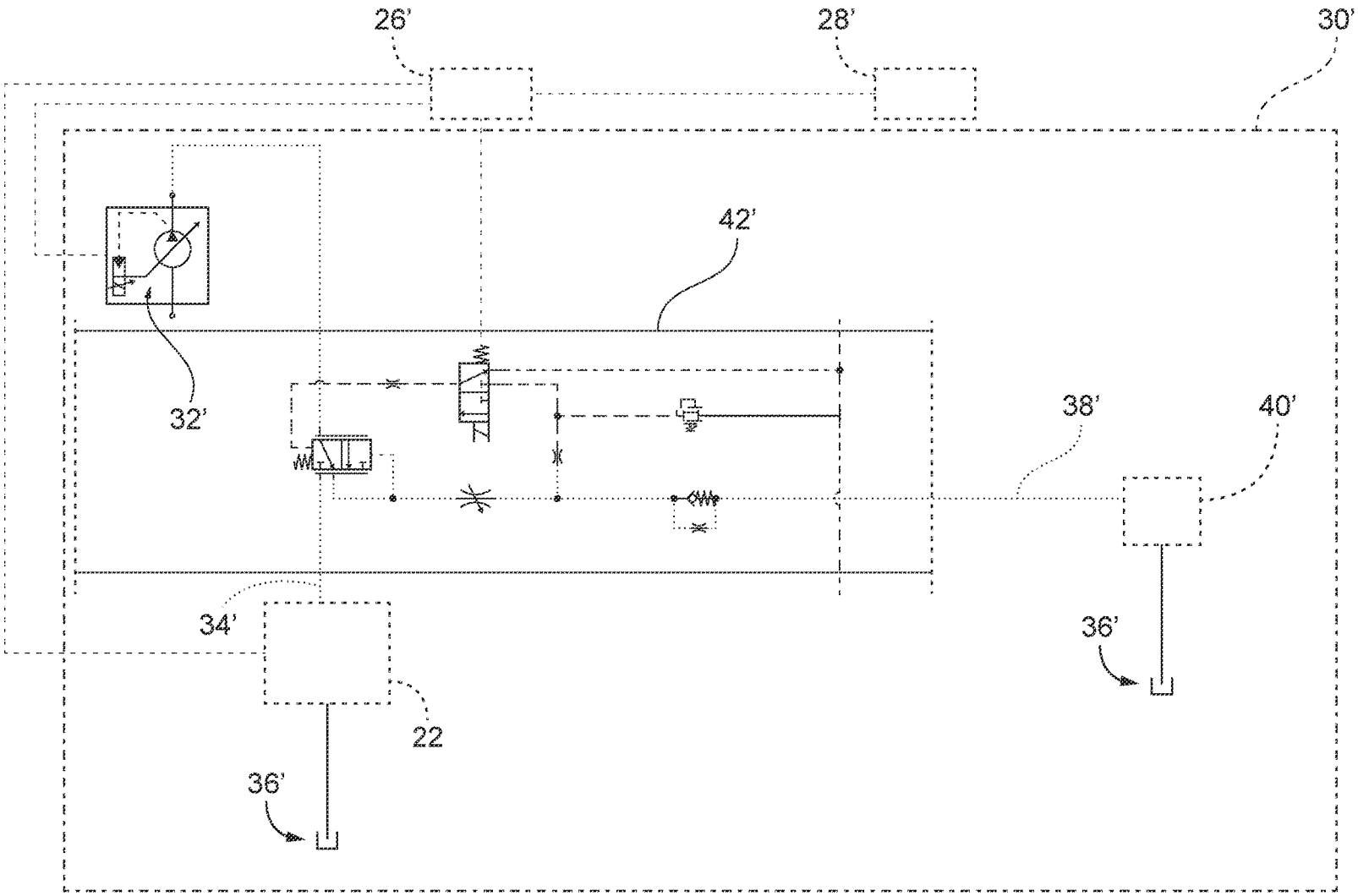
FIG. 3 is a schematic view of a control system of the work vehicle of FIG. 1.

FIG. 3 illustrates a control system that includes a controller 26', a battery 28' and a hydraulic system 30'. The controller 26' is in electrical communication with the battery 28' such that the controller 26 monitors a charge status of the battery 28. The controller 26' is in electrical communication with the hydraulic system 30'.

The hydraulic system 30' includes a pump 32', a first conduit 34', a reservoir 36', a second conduit 38', a fluid resistor 40', and a valve 42'. The pump 32' pumps hydraulic fluid in response to a signal from the controller 26'. While the illustrated pump 32' is a displacement-controlled pump, other suitable pumps could be used in other embodiments.

The first conduit 34' selectively fluidly connects the pump 32' and the second attachment 22. The reservoir 36' contains hydraulic fluid and, in the illustrated embodiment, is fluidly connected to the second attachment 22. The second conduit 38' selectively fluidly connects the pump 32' to the reservoir 36'.

The fluid resistor 40' is fluidly connected with the second conduit 38' between the valve 42' and the reservoir 36'. The fluid resistor 40' dissipates power from the work vehicle 10. In some embodiments, the fluid resistor 40' is a fixed orifice. In other embodiments, the fluid resistor 40' is a needle valve.

The valve 42' is in electrical communication with the controller 26'. The valve 42' is actuatable between a first state and a second state in response to one or more signals from the controller 26'. In the first state, the valve 42' fluidly connects the pump 32' to the second attachment 22. In the second state, the valve 42' fluidly connects the pump 32' to the fluid resistor 40'. In some embodiments, the valve 42' is one of the valves in a valve stack associated with the second attachment 22 of the work vehicle 10. In some embodiments, the valve 42' is one of the valves in a valve stack associated with the first attachment 20 of the work vehicle 10.

The controller 26' monitors a state of charge of the battery 28'. While the state of charge of the battery 28' indicates that the battery 28' is not fully charged, and thus capable of receiving a further charge, the controller 26' sends a first signal to actuate the valve 42' to the first state. While the state of charge of the battery 28' indicates that the battery 28' is fully charged, and thus not capable of receiving a further charge, the controller 26' sends a second signal to actuate the valve 42' to the second state. While the chare status of the battery 28' indicates that the battery is too hot or too cold to receive a further charge, the controller 26' sends the second signal to actuate the valve 42' to the second state.

With reference to FIGS. 2 and 3, in some situations, a further charge is provided to the battery 28, 28' while the work vehicle 10 moves down an incline while the valve 42, 42' is in the first state. The potential and kinetic energy from moving down the incline are converted into chemical energy in the battery 28, 28'. This energy conversion can provide some motor braking to control the speed of the work vehicle 10.

In some situations, the battery 28, 28' is fully charged and cannot receive a further charge. In other situations, the battery 28, 28' is too hot or too cold to receive a further charge. While the battery 28, 28' is unable to receive a further charge, the controller 26, 26' sends the second signal to the valve 42, 42' to actuate the valve 42, 42' to the second state. While the valve 42, 42' is in the second state, the energy is dissipated by the fluid resistor 40, 40'. The fluid resistor 40, 40' provides motor braking to limit a speed of the work vehicle 10.

In some embodiments, the fluid resistor 40, 40' creates a load to dissipate energy generated by the work vehicle 10 while the work vehicle 10 is traveling down an incline. In some embodiments, the fluid resistor 40, 40' creates a load to consumer or dissipate power generated by the work vehicle 10 while the work vehicle 10 is traveling down an incline. The fluid resistor 40, 40' consumes the energy and power generated by the work vehicle 10. In some embodiments, the fluid resistor 40, 40' creates a load to create hydraulic braking while the work vehicle 10 is traveling down an incline.

In some embodiments, the fluid resistor 40, 40' is configured to dissipate or consume between 1 and 50 kW of power. In some embodiments, the fluid resistor 40, 40' is configured to dissipate or consume between 1 and 35 kW of power. In some embodiments, the fluid resistor 40, 40' is configured to dissipate or consume between 1 and 25 kW of power. In some embodiments, the fluid resistor 40, 40' is configured to dissipate or consume between 1 and 20 kW of power.

The controller 26, 26' functions as a battery management system to monitor and manage the state of charge of the battery 28, 28' and adjust the status of the valve 42, 42' accordingly.

What is claimed is:

1. A work vehicle comprising:

a frame;

a ground-engaging implement configured to move the frame over a ground surface;

an attachment coupled to the frame for movement with respect to the frame;

a controller in electrical communication with the attachment;

a battery in electrical communication with the controller, wherein the controller is configured to monitor a battery state of charge; and a hydraulic system in electrical communication with the controller, the hydraulic system including a pump configured to pump hydraulic fluid, a first conduit fluidly connecting the pump and the attachment, a reservoir configured to contain hydraulic fluid, a second conduit fluidly connecting the pump to the reservoir, a fluid resistor fluidly connected with the second conduit, the fluid resistor configured to dissipate power from the work vehicle, and a valve actuatable between a first state in which the valve fluidly connects the pump to the first conduit such that hydraulic fluid is directed to the attachment, and a second state in which the valve fluidly connects the pump to the second conduit such that fluid is directed through the fluid resistor and into the reservoir, wherein the controller is configured such that while a first signal from the battery indicates that the battery is unable to be further charged, the controller sends a second signal to the valve to actuate the valve into the second state.

2. The work vehicle of claim 1, wherein the controller is configured such that while the first signal from the battery indicates that the battery is capable of receiving a further charge, the controller sends a third signal to the valve to actuate the valve into the first state.

3. The work vehicle of claim 1, wherein the fluid resistor is configured to dissipate energy generated by the work vehicle traveling down an incline.

4. The work vehicle of claim 1, further comprising a motor configured to move the work vehicle, wherein the fluid resistor is configured to provide motor braking while the work vehicle is moving down an incline and while the valve is in the second state.

5. The work vehicle of claim 1, wherein the fluid resistor is a fixed orifice or a needle valve.

6. A control system for a work vehicle having a frame, a ground-engaging implement configured to move the frame over a ground surface, and an attachment coupled to the frame for movement with respect to the frame, the control system comprising:

a controller in electrical communication with the attachment;

a battery in electrical communication with the controller such that the controller is operable to monitor a battery state of charge;

a pump configured to pump hydraulic fluid in response to a signal from the controller; and a valve in electrical communication with the controller, the valve actuatable between a first state in which the valve fluidly connects the pump to the attachment in response to a first signal from the controller, and a second state in which the valve fluidly connects the pump to a fluid resistor in response to a second signal from the controller, the fluid resistor configured to dissipate power from the work vehicle, wherein the controller is configured such that while the battery state of charge indicates that the battery is able to be further charged, the controller sends the first signal to actuate the valve to the first state, and wherein the controller is configured such that while the battery state of charge indicates that the battery is unable to be further charged, the controller sends the second signal to actuate the valve to the second state.

7. The control system of claim 6, wherein the fluid resistor is configured to dissipate energy generated by the work vehicle traveling down an incline.

8. The control system of claim 6, wherein the work vehicle includes a motor configured to move the work vehicle, and wherein the fluid resistor is configured to provide motor braking while the work vehicle is moving down an incline and while the valve is in the second state.

9. The control system of claim 6, wherein the fluid resistor is a fixed orifice.

10. The control system of claim 6, wherein the fluid resistor is a needle valve.

11. A hydraulic system for a work vehicle having a frame, a ground-engaging implement configured to move the frame over a ground surface, an attachment coupled to the frame for movement with respect to the frame, a controller, and a battery in electrical communication with the controller, and wherein the controller is configured to monitor a battery state of charge, the hydraulic system comprising:

a pump configured to pump hydraulic fluid;

a first conduit fluidly connecting the pump and the attachment;

a reservoir configured to contain hydraulic fluid;

a second conduit fluidly connecting the pump to the reservoir;

a fluid resistor fluidly connected with the second conduit, the fluid resistor configured to dissipate power from the work vehicle; and a valve actuatable between a first state in which the valve fluidly connects the pump to the first conduit such that hydraulic fluid is directed to the attachment, and a second state in which the valve fluidly connects the pump to the second conduit such that fluid is directed through the fluid resistor and into the reservoir, wherein the controller is configured such that while a first signal from the battery indicates that the battery is unable to be further charged, the controller sends a second signal to the valve to actuate the valve into the second state.

12. The hydraulic system of claim 11, wherein the controller is configured such that while the first signal from the battery indicates that the battery is capable of receiving a further charge, the controller sends a third signal to the valve to actuate the valve into the first state.

13. The hydraulic system of claim 11, wherein the fluid resistor is configured to dissipate energy generated by the work vehicle traveling down an incline.

14. The hydraulic system of claim 11, wherein the vehicle includes a motor configured to move the work vehicle, and wherein the fluid resistor is configured to provide motor braking while the work vehicle is moving down an incline and while the valve is in the second state.

15. The hydraulic system of claim 11, wherein the fluid resistor is a fixed orifice.

16. The hydraulic system of claim 11, wherein the fluid resistor is a needle valve.

* * * * *